US006342755B1

(12) United States Patent
Russ et al.

(10) Patent No.: US 6,342,755 B1
(45) Date of Patent: Jan. 29, 2002

(54) FIELD EMISSION CATHODES HAVING AN EMITTING LAYER COMPRISED OF ELECTRON EMITTING PARTICLES AND INSULATING PARTICLES

(75) Inventors: Benjamin E. Russ, San Diego, CA (US); Ichiro Saito, Kanagawa (JP); Jack Barger, El Cajon, CA (US)

(73) Assignees: Sony Corporation (JP); Sony Electronics, Inc., Park Ridge, NJ (US)

( * ) Notice: Subject to any disclaimer, the term of this patent is extended or adjusted under 35 U.S.C. 154(b) by 0 days.

(21) Appl. No.: 09/373,028

(22) Filed: Aug. 11, 1999

(51) Int. Cl.[7] ..... H01J 1/02; H01J 1/14; H01J 19/06; H01J 1/16; H01J 19/10

(52) U.S. Cl. ..... 313/310; 313/309; 313/336; 313/351; 313/346 R; 313/495; 313/497; 445/50; 445/51

(58) Field of Search ..... 313/309, 310, 313/311, 336, 346 R, 351, 495–497; 445/50, 51, 24; 427/77

(56) References Cited

U.S. PATENT DOCUMENTS

| | | | | | |
|---|---|---|---|---|---|
| 4,143,292 | A | | 3/1979 | Hosoki et al. | 313/336 |
| 4,305,188 | A | | 12/1981 | Momoi | 29/25.17 |
| 4,498,952 | A | * | 2/1985 | Christensen | 313/309 X |
| 4,663,559 | A | * | 5/1987 | Christensen | 313/336 |
| 5,167,555 | A | | 12/1992 | Tanaba | 445/19 |
| 5,319,279 | A | | 6/1994 | Watanabe et al. | 313/309 |
| 5,332,627 | A | | 7/1994 | Watanabe et al. | 428/426 |
| 5,534,749 | A | | 7/1996 | Ohoshi et al. | 313/497 |
| 5,608,283 | A | | 3/1997 | Twichell et al. | 313/309 |
| 5,656,883 | A | * | 8/1997 | Christensen | 313/310 |
| 5,747,918 | A | | 5/1998 | Eom et al. | 313/309 |
| 5,755,944 | A | | 5/1998 | Haven et al. | 204/486 |
| 5,783,906 | A | | 7/1998 | Moore et al. | 313/586 |
| 5,828,162 | A | * | 10/1998 | Danroc et al. | 313/309 |
| 5,836,796 | A | * | 11/1998 | Danroc | 445/24 |
| 6,084,338 | A | * | 7/2000 | Bojkov et al. | 313/309 |
| 6,097,139 | A | * | 8/2000 | Tuck et al. | 313/310 |
| 6,116,975 | A | * | 9/2000 | Saito et al. | 445/24 |

FOREIGN PATENT DOCUMENTS

| | | | |
|---|---|---|---|
| JP | 8-241664 | 9/1996 | H01J/1/30 |

OTHER PUBLICATIONS

C.A. Spindt et al., "Physical Properties of Thin–Film Field Emission Cathodes With Molybdenum Cones", Journal of Applied Physics, vol. 47, No. 12, Dec. 1976, pp. 5248–5263.

Shigeo Itoh et al., "Investigation of Cathodoluminescent Display Device with Field Emission Cathodes", Jpn. J. Applied Physics, vol. 32, Part I, No. 9A, Sep. 1993, pp. 3955–3961 including cover and.

Michael J. Shane et al., "Electrophoretic Deposition of Phosphors for Display Technology", Mat. Res. Soc. Symp. Proc., vol. 345, 1994 Materials Research Society.

(List continued on next page.)

*Primary Examiner*—Nimeshkumar D. Patel
*Assistant Examiner*—Mack Haynes
(74) *Attorney, Agent, or Firm*—Skjerven Morrill MacPherson LLP; David W. Heid

(57) ABSTRACT

Electrophoretic deposition provides an efficient process for manufacturing a field emission cathode. Particles of an electron emitting material mixed with particles of an insulating material are deposited by electrophoretic deposition on a conducting layer overlying an insulating layer to produce the cathode. By controlling the composition of the deposition bath and by mixing insulating particles with emitting particles, an electrophoretic deposition process can be used to efficiently produce field emission cathodes that provide spatially and temporally stable field emission. The deposition bath for the field emission cathode includes an alcohol, a charging salt, water, and a dispersant. The field emission cathodes can be used as an electron source in a field emission display device.

35 Claims, 2 Drawing Sheets

OTHER PUBLICATIONS

Benjamin E. Russ et al., "A Study of the Variables Affecting Adhesion Strength of Electrophorectically Deposited Phosphors", Journal of the SID, 1996, pp. 207–211.

Byung–Soo Jeon et al., "Electrophoretic Deposition of ZnO:Zn Phospher for Field Emission Display Applications", J. Electrochemical Soc., Vo. 143, No. 12, Dec. 1996, pp. 3923–3927.

Benjamin E. Russ et al., "An Analysis of the Binder Formation in Electrophoretic Deposition", J. Electrochemical Soc., vol. 145, No. 4, Apr. 1998, pp. 1253–1256.

Benjamin E. Russ et al., "A Study of the Adhesion of Electrophoretically Deposited Phosphors", J. Electrochemical. Soc., vol. 145, No. 4, Apr. 1998, pp. 1245–1252.

Sang Won Kang et al., "Photolithographic Patterning of Phosphor Screens by Electrophoretic Deposition for Field Emission Display Application", J. Vac. ci. Technol. B 16(5), Sep./Oct. 1998, pp.

Y.W. Jin et al., "Performance of Electrophoretic Deposited Low Voltage Phosphors for Full Color Field Emission Dissplay Devices", J. Vac. Sci. Technol. B 17(2), Mar./Apr. 1999, pp. 489–493.

* cited by examiner

FIELD EMISSION CATHODES HAVING AN EMITTING LAYER COMPRISED OF ELECTRON EMITTING PARTICLES AND INSULATING PARTICLES

TECHNICAL FIELD

This invention relates generally to field emission display devices, and in particular, to methods of manufacturing cathodes for field emission devices.

BACKGROUND

Field emission displays (FEDs) are flat panel display devices that combine the size and portability advantages of liquid crystal displays (LCDs) with the performance of conventional cathode ray tubes (CRTs). FED devices typically include a field emission cathode positioned opposite a flat screen coated with phosphors. The phosphors emit light in response to bombardment by electrons from the cathode to produce an image. The field emission cathode emits electrons when subjected to an electric field of sufficient strength. The cathode typically includes thousands of microscopic emitter tips for each pixel of the screen. It is principally the emissive nature of the cathode that give FEDs the thin, flat screen features of an LCD with the viewing angle, brightness, and response speed of a CRT.

While FEDs are potentially very attractive devices, a limiting factor in the widespread adoption of the technology is the difficulty of manufacturing the devices, particularly the difficulty in manufacturing the FED cathodes. Field emission cathodes have been known for some time. See, for example, Spindt et al. J. of Appl. Phys. 47,5248 (1976). The field emission cathodes described therein typically comprise sharp-tip metal electron emitters, such as molybdenum cones having a tip radius of the order of a few tens of nanometers. A method of manufacturing such cathodes with Mo cone emitters on a conductive substrate using semiconductor fabrication techniques is described, of example, in U.S. Pat. No. 5,332,627 to Watanabe et al. Another example of the use of semiconductor fabrication techniques, including patterning and etching, to manufacture emitter cone structures is provided in U.S. Pat. No. 5,755,944 to Haven et al.

The benefits of using carbon in the form of graphite or diamond as the emitting material in a field emission cathode have been recognized. A manufacturing process that includes in situ growth of diamond emitter bodies, by for example, chemical vapor deposition (CVD) or flame deposition, or alternatively deposition of pre-existing diamond grit or powder is described in U.S. Pat. No. 5,747,918 to Eom et al. Another approach to fabricating a carbon-based field emitter is given in U.S. Pat. No. 5,608,283 to Twichell et al. which avoids diamond CVD and uses fewer semiconductor processing steps than some of the approaches reported above.

Despite the variety of processes for producing field emission cathodes that have been developed, there remains a need for improved manufacturing techniques that avoid the complications of previous approaches described above. It would be desirable for the improved techniques for field emission cathodes to be scalable so that large field emission displays can be fabricated at reasonable cost without defects.

SUMMARY

Electrophoretic deposition provides an efficient process for manufacturing a field emission cathode. Particles of an electron emitting material are deposited by electrophoretic deposition on a conducting layer overlying an insulating layer to produce the cathode. According to an aspect of the present invention, insulating particles are mixed with electron emitting particles in the deposited layer. Desired properties of a field emission cathode include requisite adhesion strength of the emitting particles to the conducting layer, sufficient emission when an electric field is applied to the cathode, and spatial and temporal stability of the field emission. According to another aspect of the present invention, by controlling the composition of the deposition bath and by mixing insulating particles with emitting particles, an electrophoretic deposition process can be used to efficiently produce field emission cathodes with the desired characteristics.

Electron emitting materials that can be used for the emitting particles include metals, semiconductors, metal-semiconductor compounds, and forms of carbon. For example, graphite carbon, diamond, amorphous carbon, molybdenum, tin, and silicon, all in powder form, are advantageously used as emitting particles. Beneficial particle sizes are between about 0.05 $\mu$m and about 20 $\mu$m. Dispersed, rather than uniform, particle size distributions are preferred to improve packing.

The insulating particles are composed of a material that has a band gap that is greater than or equal to about 2 eV and is available in powder form. Particular examples of insulating materials used for the insulating particles include $\gamma$-alumina, other alumina phases, silicon carbide, and oxides of titanium and zirconium. Best results are achieved for insulating particles between about a quarter and about a half the characteristic size of the emitting particles. The ratio of emitting particles to insulating particles varies between about 0.1% to about 99% emitting particles by weight, preferably between about 5% and about 50% emitting particles, depending on the particular materials. For graphite carbon particles as emitting particles and $\gamma$-alumina particles as insulating particles, a mixture with about 20% graphite carbon particles by weight gives advantageous results.

In electrophoretic deposition, particles suspended in a deposition bath are deposited onto a conducting substrate under the influence of an electric field. The composition of the deposition bath plays a crucial role in the electrophoretic deposition process. According to an aspect of the invention, the deposition bath for the field emission cathode includes an alcohol, a charging salt, water, and a dispersant. The dominant component of the deposition bath is a reasonably hydrophilic alcohol such as a propanol, butanol, or an octanol. A charging salt such as $Mg(NO_3)_2$, $La(NO_3)_2$, or $Y(NO_3)_2$, at a concentration of between about $10^{-5}$ to $10^{-1}$ moles/liter is added to the alcohol. The metal nitrates partially dissociate in the alcohol and the positive dissociation product adsorbs onto the emitting particles and insulating particles charging them positively. The water content has a significant effect on the adhesion of particles to the conductive layer and to each other. The dissolved charging salt reacts with hydroxide ions from the reduction of water to form a hydroxide that serves as a binder. Water content of between about 1% and about 30% by volume is used to increase the adhesion of deposited particles. The deposition bath also includes a dispersant, for example, glycerin, at a concentration of from 1% to 20% by volume of the deposition bath. Particularly advantageous results are obtained for deposition of graphite carbon particles in the size range between about 0.1 and 1.0 $\mu$m mixed with about 0.05 $\mu$m $\gamma$-alumina particles in a ratio of 20:80 by weight in a deposition bath of isopropyl alcohol containing $10^{-3}$ molar $Mg(NO_3)_2$ with 3% water by volume and 1% glycerin by volume.

The field emission cathodes produced according to the method of the present invention exhibit emission with excellent spatial and temporal stability. The emitting layer is a uniform deposit and has good adhesion to the underlying substrate. The field emission cathodes so produced can be used as an electron source in a field emission display device.

DETAILED DESCRIPTION

Figure 1A:
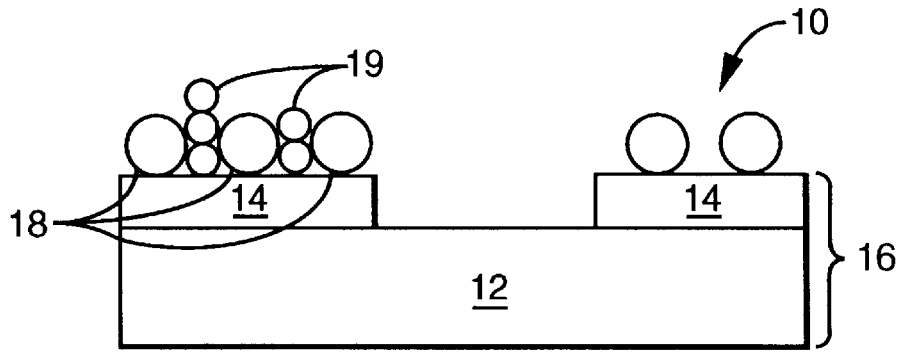
FIG. 1*a* is a schematic cross section of a field emission cathode according to an aspect of the present invention.

Electrophoretic deposition provides an efficient process for manufacturing a field emission cathode. Particles of an electron emitting material are deposited on a conducting layer by electrophoretic deposition to produce the cathode. In electrophoretic deposition, particles suspended in a non-aqueous medium are deposited onto a conducting substrate under the influence of an electric field. Desired properties of a field emission cathode include requisite adhesion strength of the emitting particles to the conducting layer, sufficient emission when an electric field is applied to the cathode, and spatial and temporal stability of the field emission. According to an aspect of the present invention, by controlling the composition of the deposition bath and by mixing insulating particles with emitting particles, an electrophoretic deposition process can be used to efficiently produce field emission cathodes with the desired characteristics.

FIG. 1 is a schematic cross section of field emission cathode 10 which includes conductive material 14 supported on an insulating substrate 12. Substrate 12 and conductive material 14 together constitute cathode support 16. Conductive material 14 can completely cover substrate 12 or it may form a pattern on substrate 12. Particles 18 of an electron emitting material are bonded to conductive material 14. Particles 18 are separated from each other by insulating particles 19. The presence of insulating particles 19 improves the properties of field emission cathode 10.

Without being bound to any theory, the beneficial effects of insulating particles 19 are explained as follows. When field emission cathode 10 is placed opposite, and spaced from, an anode in vacuum, and a voltage is applied between cathode 10 and the anode, particles 18 of electron emitting material, eject electrons by field emission. If multiple particles 18 touch each other, they constitute a single emission site. In FIG. 1*b,* for example, particles 18*a,* 18*b,* and 18*c* act as a single emission site. When insulating particles 19 isolate the emitting particles from each other, each emitting particle 18 can potentially provide a separate emitting site. Increases in emission current and in temporal stability of emission are observed when insulating particles are used.

Substrate 12 of field emission cathode 10 is made of a rigid insulating material such as glass, ceramic, or plastic. Metals and metal oxides are used for conductive material 14. Particular examples of conductive materials used in conductive material 14 include indium tin oxide (ITO), gold, chromium, aluminum, and chromium oxide. Electron emitting materials that can be used in field emission devices include metals, semiconductors, metal-semiconductor compounds, and forms of carbon such as graphite, diamond, and amorphous carbon. For example, graphite carbon, molybdenum, tin, and silicon, all in powder form, are advantageously used as emitting particles 18 in cathode 10. Additional emitter materials include tungsten, zirconium oxide coated tungsten, n-type doped silicon, porous silicon, metal silicides, nitrides such as gallium nitride, and gallium arsenide on a heavily doped n-type substrate. Beneficial particle sizes are between about 0.05 $\mu$m and about 20 $\mu$m. Dispersed, rather than uniform, particle size distributions are preferred to improve packing.

Figure 1B:
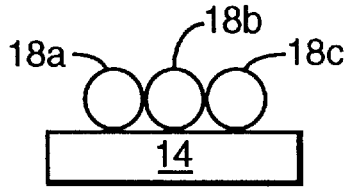
FIG. 1*b* illustrates emitting particles bound to the conducting material of a field emission cathode.

As shown in FIG. 1*a,* insulating particles 19 are smaller in size than emitting particles 18. Best results are achieved for insulating particles between about a quarter and about a half the characteristic size of the emitting particles. Insulating particles 19 are composed of a material that has a band gap greater than or equal to about 2 electron volts and is available in powder form. Insulating particles that are approximately spherical or cubic in shape are used. Particular examples of insulating materials used for particles 19 include $\gamma$-alumina, other alumina phases such as $\alpha$-, $\beta$-, $\delta$-, and $\zeta$-alumina, silicon carbide, and oxides of titanium and zirconium. The ratio of emitting particles 18 to insulating particles 19 depends on the materials selected. The particle composition can vary between about 0.1% to about 99% emitting particles by weight, preferably between about 5% and about 50% emitting particles. For example, for graphite carbon particles as emitting particles 18 and $\gamma$-alumina particles as insulating particles 19, a mixture with about 20% graphite carbon particles by weight gives advantageous results.

Figure 2:
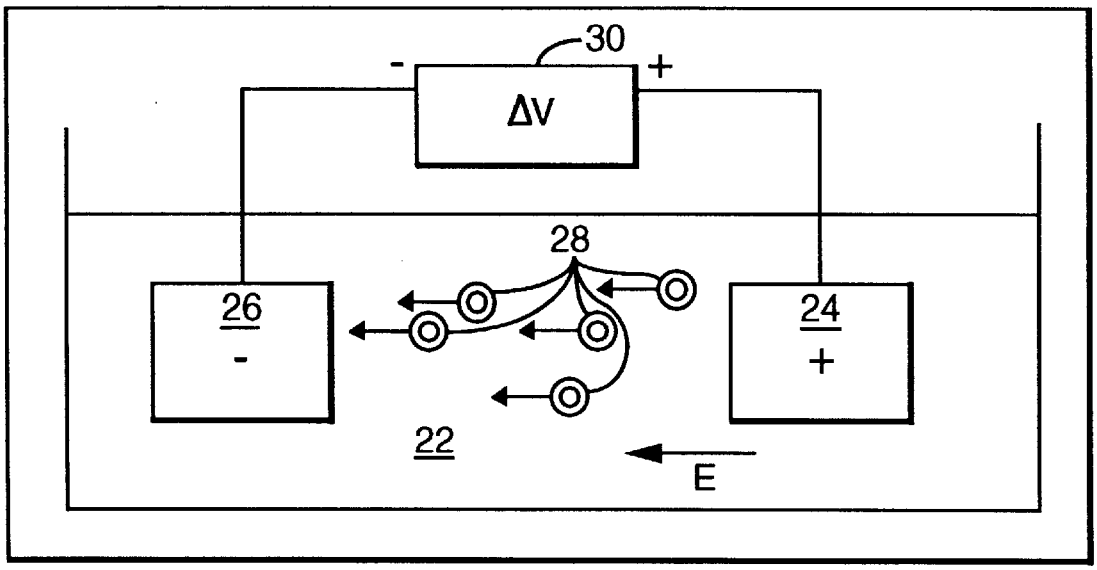
FIG. 2 is a schematic diagram of an electrophoretic deposition cell in which aspects of the present invention are performed.

An electrophoretic deposition cell 20 used to produce field emission cathode 10 is shown generically in FIG. 2. A negative electrode (cathode) 26 and a positive electrode (anode) 24 are suspended in a liquid deposition bath 22. Positively charged particles 28 are suspended in the deposition bath. The method by which the particles are charged is discussed below. Voltage source 30 applies a voltage that produces an electric field E in the region between the positive electrode 14 and the negative electrode 12. Under the influence of electric field E, positively charged particles 28 migrate toward the negatively charged electrode 26. To produce field emission cathode 10, charged particles 28 comprise the desired mixture of emitting particles 18 and insulating particles 19. Cathode support 16, of FIG. 1 is used as the negative electrode 26. Under the influence of electric field E, the mixture of particles 18 and 19 is deposited on cathode support 16 to produce field emission cathode 10.

The composition of deposition bath 22 plays a crucial role in the electrophoretic deposition process. According to an aspect of the invention, deposition bath 22 includes an alcohol, a charging salt, water, and a dispersant. The dominant component of the deposition bath 22 is a reasonably hydrophilic alcohol such as a propanol, butanol, or an octanol. Any alcohol that is miscible with water can be used. A charging salt, such as $Mg(NO_3)_2$, is dissolved in the alcohol. One effect of the charging salt is to impart an electrical charge to the emitting particles 18 and insulating particles 19. The $Mg(NO_3)_2$ dissociates partially in two steps in the alcohol:

$$Mg(NO_3)_2 \rightarrow Mg(NO_3)^+ + NO_3^-$$

$$Mg(NO_3)^+ \rightarrow Mg^{2+} + NO_3^-$$

The $Mg(NO_3)^+$ ions adsorb onto the emitting particles 18 and insulating particles 19, charging them positively. Charging salt concentrations between about $10^{-5}$ and about $10^{-1}$ moles/liter are used.

The water content of the deposition bath 22 has a significant effect on the adhesion of the deposited emitting particles 18 and insulating particles 19 to the conductive material 14 and of the particles to each other. When water is present as part of the deposition bath, the dissolved charging salt reacts to form a hydroxide that serves as a binder. For example, with $Mg(NO_3)_2$ as the charging salt, the reactions:

$$2H_2O+2e^- \rightarrow H_{2(g)}\uparrow+2OH^-$$

$$Mg(NO_3)^++2OH^- \rightarrow Mg(OH)_2+NO_3^-$$

lead to formation of magnesium hydroxide. Water content of the deposition bath of between about 1% and about 30% by volume has been found to increase adhesion strength. When water content is too high, evolution of hydrogen gas interferes with particle deposition on conductive material 14. The charging salt is chosen, therefore, such that the salt of the metal is soluble in the chosen solvent (predominantly alcohol) but the metal hydroxide is insoluble in the chosen solvent. Other examples of charging salts include the nitrates of lanthanum and yttrium.

Finally, the deposition bath also includes a dispersant such as glycerin, which also is found to increase adhesion strength. Alternative dispersants include carboxy methyl cellulose, nitro cellulose, and ammonium hydroxide. Including a dispersant in the deposition bath leads to a higher packing density of particles on the patterned conductive material 14. It has been suggested that the hydroxide binder deposits in interstitial regions between the particles and that adhesion is due to the contact points between particles. By increasing the packing density of the deposit, the number of contact points is increased and thus a higher adhesion strength is achieved. Dispersant concentrations can range from about 1% to about 20% by volume of the deposition bath. The optimal percentages of the different components of the deposition bath depend on the identity of the emitting particles, insulating particles, and of the individual components. As shown in the examples below, advantageous results were obtained for deposition of graphite carbon particles in the size range between about 0.1 and 1.0 $\mu$m and about 0.05 $\mu$m $\gamma$-alumina particles in a ratio of 20:80 by weight in a deposition bath of isopropyl alcohol containing $10^{-3}$ molar $Mg(NO_3)_2$ with 3% water by volume and 1% glycerin by volume.

The emitting particles and insulating particles are deposited on cathode support 16 to produce field emission cathode 10 using a parallel plate method of electrophoretic deposition. In parallel plate deposition, a counter electrode, such as positive electrode 24, of the same size and shape as cathode support 16 is positioned parallel to and spaced from cathode support 16. For example, for an ITO patterned 5 cm square glass plate as cathode support 16, a stainless steel positive electrode 24 is placed at a spacing of approximately 3 cm. The deposition bath as described above is prepared by combining the alcohol, charging salt, water, and dispersant. A mixture of emitting particles and insulating particles is added to the deposition bath. Suitable particle loadings are from about 0.01 to about 10 grams/liter with approximately 3–4 g/l being representative. The particles may be ball milled with glass beads to break up any agglomerates prior to being added to the deposition bath. For example, carbon particles in the size range of about 0.1 to 1.0 $\mu$m are ball milled with 3 mm glass beads for approximately 4 hours prior to deposition.

The cathode support 16 and counter electrode 24 are placed in the particle-loaded deposition bath and a DC voltage is applied between conductive material 14 and counter electrode 24 to obtain a current density of from about 0.5 to about 2 mA/cm$^2$. The thickness of the deposit is proportional to the amount of time the voltage is applied. Time and voltages may vary with deposition bath composition and cathode pattern. For example, a voltage of 200 V applied for 90 seconds gave a 25 $\mu$m thick carbon/alumina deposit on conductive material 14 composed of a patterned layer of aluminum. After the voltage is turned off, the cathode is removed from the bath, rinsed with an alcohol, for example, the alcohol component of deposition bath 22, allowed to dry in air and baked at a temperature between about 400 and 550° C. for from about 10 minutes to 2 hours to convert the hydroxide formed from the charging salt to an oxide.

The field emission cathode 10 produced by the electrophoretic method described above appears uniform on visual inspection. Furthermore, the deposited layer of particles 18 and 19 shows reasonable adhesion. The layer is not dislodged when a finger is wiped across the surface in a procedure referred to as the "finger-wipe" test. As is well known in the art, achieving good adhesion of electrophoretically deposited layers has been a challenging technical problem in the past. Finally field emission cathode 10 exhibits excellent emission characteristics.

Figure 3:
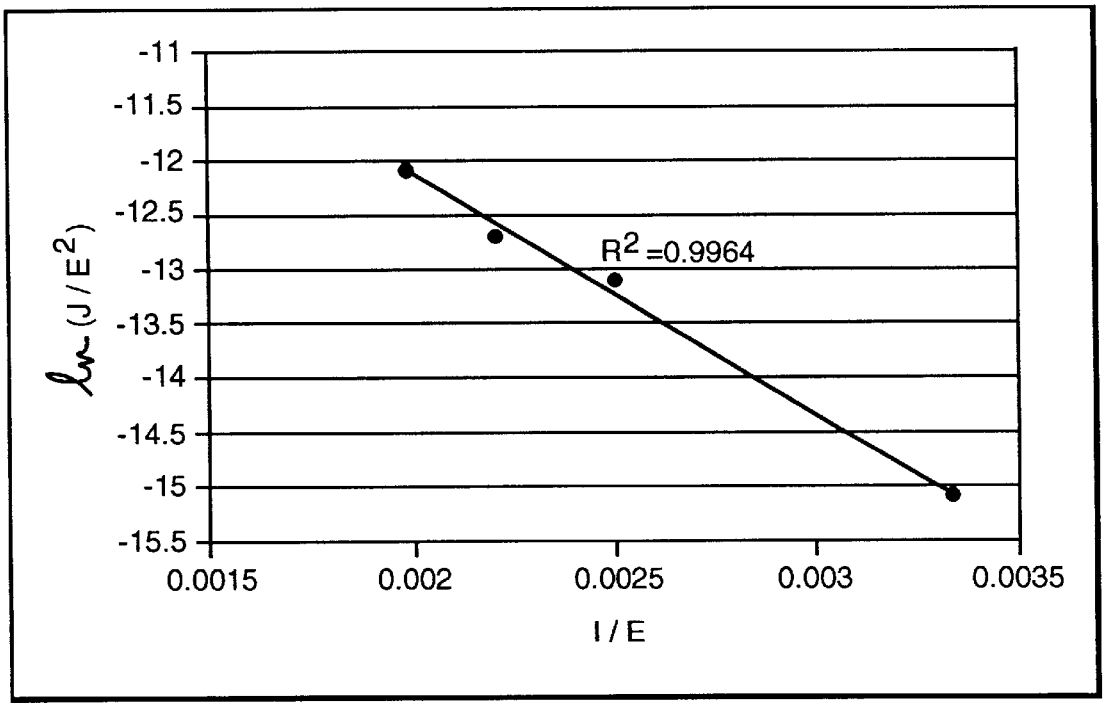
FIG. 3 is a plot of $\ln(J/E^2)$ vs. 1/E where J is the current density and E is the applied electric field for a cathode according to an aspect of the present invention. The points represent the measured values and the straight line is a least squares fit to the data.

The emission characteristics of field emission cathode 10 are measured in a second parallel plate configuration. In one example of a measurement configuration, the cathode 10 is spaced about 150 $\mu$m from a phosphor coated transparent conductor of similar shape, which constitutes a counter electrode, here the anode. The cathode 10 and the anode are connected to an appropriate power supply and placed in vacuum of approximately $10^{-5}$ to $10^{-6}$ torr. A positive potential ranging from about 200 to about 1500 V (1.3–10V/$\mu$m) is applied to the anode and the emission current is recorded as a function of applied voltage. The emission current for field emission should follow the Fowler-Nordheim equation:

$$ln(J/E^2)=a(1/E)+b$$

where J is the current density, E is the applied field and a and b are constants. The plot of ln (J/E$^2$) vs 1/E in FIG. 3 for a field emission cathode 10 prepared according to the electrophoretic method described above and measured in the second parallel plate configuration exhibits the linear dependence characteristic of field emission. The phosphors on the anode allow identification of the field emission sites. Field emission cathode 10, according to the present invention, evidences sufficient density of emitting sites along the edges of conducting substrate 14 that the emission appears continuous. Finally, the emission of cathode 10, as measured in the second parallel plate configuration showed temporal stability. For example, as reported in Example 7 below, cathode 10 exhibited less than a 5% deviation in emission current over an hour.

The field emission cathode can be combined with a driving anode and a phosphor coated anode to produce a field emission display. The driving anode is analogous to the gate electrode of conventional field emission cathodes. Using an appropriate pattern of the cathode and gate electrode, desired display characteristics can be achieved. Such a display can easily be scaled to large sizes since the electrophoretic deposition techniques and equipment can be scaled accordingly to provide a uniform electric field on the cathode electrode during deposition of the emitting material.

In contrast, technologies dependent on semiconductor processing techniques to fabricate the cathodes do not scale easily.

The methods of electrophoretic deposition of field emission cathode 10 and the characterization of the cathodes so produced are further illustrated in the following examples.

EXAMPLE 1

Comparative Example 1.2 g of Hitachi GP-60S carbon graphite powder in the size range of 0.1–1.0 μm that had been ball milled for 4 hours with 3mm glass beads were added to 300ml of $10^{-3}$ M $Mg(NO_3)_2$ in isopropyl alcohol (IPA) to produce a deposition bath loaded at 4g/l. A 2.5×5 cm patterned aluminum substrate on a glass support was placed in the deposition bath positioned 3 cm from a stainless steel counter electrode. A DC voltage of 200 V was applied for 90 seconds to produce a field emission cathode comprising a 25 μm deposit on the substrate. The cathode was rinsed with IPA, dried in air and baked at 425° C. for 20 minutes. Characteristics of the cathode produced in this and the following examples are listed in Example 8 below.

EXAMPLE 2

Comparative Example

A loaded deposition bath was prepared as in Example 1 except for the addition of 1% glycerin by volume to the IPA. A 2.5×5 cm patterned aluminum substrate on a glass support was placed in the deposition bath positioned 3 cm from a stainless steel counter electrode. A DC voltage of 125 V was applied for 90 seconds to produce a field emission cathode comprising a 25 μm deposit on the substrate. The cathode was rinsed with IPA, dried in air and baked at 450° C. for 20 minutes

EXAMPLE 3

Comparative Example

A loaded deposition bath was prepared as in Example 1 except for the addition of 3% water by volume to the IPA. A 2.5×5 cm patterned aluminum substrate on a glass support was placed in the deposition bath positioned 3 cm from a stainless steel counter electrode. A DC voltage of 125 V was applied for 90 seconds to produce a field emission cathode comprising a 25 μm deposit on the substrate. The cathode was rinsed with IPA, dried in air and baked at 450° C. for 20 minutes

EXAMPLE 4

Comparative Example

A loaded deposition bath was prepared as in Example 1 except for the addition of 1% water and 1% glycerin by volume to the IPA. A 2.5×5 cm patterned aluminum substrate on a glass support was placed in the deposition bath positioned 3 cm from a stainless steel counter electrode. A DC voltage of 100 V was applied for 90 seconds to produce a field emission cathode comprising a 25 μm deposit on the substrate. The cathode was rinsed with IPA, dried in air and baked at 450° C. for 20 minutes

EXAMPLE 5

Carbon graphite particles as in Example 1 were combined with 0.05 μm γ-alumina particles in a ratio of 1:9 carbon to alumina by weight and ball milled as in Example 1. 1 g of mixed particles was added to 300 ml of a deposition bath comprising IPA containing 1% water and 1% glycerin by volume to produce a deposition bath loaded at 3.33 g/l. A DC voltage of 125 V was applied for 90 seconds to produce a field emission cathode comprising a 25 μm deposit on the substrate. The cathode was rinsed with IPA, dried in air and baked at 450° C. for 20 minutes

EXAMPLE 6

Carbon graphite particles as in Example 1 were combined with 0.05 μm γ-alumina particles in a ratio of 1:9 carbon to alumina by weight and ball milled as in Example 1. 1 g of mixed particles was added to 300 ml of a deposition bath comprising IPA containing 3% water and 1% glycerin by volume to produce a deposition bath loaded at 3.33 g/l. A DC voltage of 125 V was applied for 90 seconds to produce a field emission cathode comprising a 25 μm deposit on the substrate. The cathode was rinsed with IPA, dried in air and baked at 450° C. for 20 minutes

EXAMPLE 7

A deposition bath was prepared as in Example 6 except that carbon graphite and γ-alumina particles were combined in a ratio of 2:8 carbon to alumina by weight. Field emission was observed from the cathode prepared from this bath at a field strength of <2V/μm. Current deviation was less than 5% over an hour.

EXAMPLE 8

The cathodes produced in Examples 1–7 were characterized according to the uniformity of the deposit on visual inspection, adhesion as determined by the finger-wipe test and uniformity of emission. Adhesion was considered average if deposited material was not removed down to the conductive substrate. Emission uniformity was judged poor if fewer than 10 separate emission sites per cm were observed along a conductive substrate edge. Observation of 20–40 sites/cm was considered average emission uniformity and continuous emission in which no individual sites could be observed was considered exceptional emission uniformity. Results are given in Table 1.

TABLE 1

| | Cathode Characteristics | | |
|---|---|---|---|
| Example | Deposit Uniformity | Adhesion | Emission Uniformity |
| Example 1 | good | average | poor |
| Comparative Example 2 | good | average | poor |
| Comparative Example 3 | poor | average | poor |
| Comparative Example 4 | good | average | poor |
| Comparative Example 5 | good | average | good |
| Example 6 | good | better | good |
| Example 7 | good | better | exceptional |

Thus it can be seen that the field emission cathode according to the present invention exhibits emission with excellent spatial and temporal stability. The emitting layer is a uniform deposit and has good adhesion to the underlying substrate. It can further be seen that the method of electrophoretic deposition method according to the present invention provides an efficient process for manufacturing a field emission cathode.

Although the invention has been described with reference to particular examples of field emission cathodes, the description is only an example of the invention's application and should not be taken as a limitation. Various adaptations and combinations of features of the examples disclosed are within the scope of the invention as defined by the following claims.

We claim:

1. A cathode comprising:

a conductive layer; and an emitting layer adjacent to the conductive layer, the emitting layer comprising a plurality of particles of an electron emitting material and a plurality of particles of an insulating material wherein the insulating material has a band gap of greater than or equal to about 2 electron volts.

2. The cathode of claim 1 wherein the emitting particles are separated from each other by the insulating particles.

3. The cathode of claim 1 wherein a characteristic size of the particles of insulating material is between about one quarter and about one half of a characteristic size of the particles of emitting material.

4. The cathode of claim 1 wherein the emitting material is selected from the group consisting of graphite carbon, diamond, amorphous carbon, molybdenum, tin, and silicon.

5. The cathode of claim 1 wherein the insulating material is selected from the group consisting of alumina, silicon carbide, titanium oxide, and zirconium oxide.

6. The cathode of claim 1 wherein the emitting material is graphite carbon, the insulating material is γ-alumina, and the fraction of graphite carbon particles is between about 5% and 50% by weight of the total weight of graphite carbon particles and γ-alumina particles.

7. The cathode of claim 6 wherein the fraction of graphite carbon particles is between about 10% and 25% by weight of the total weight of graphite carbon particles and γ-alumina particles.

8. The cathode of claim 7 wherein a characteristic dimension of the graphite carbon particles is in the range of about 0.1 μm to about 1.0 μm.

9. A field emitting device comprising the cathode of claim 1.

10. A method of making a field emitting layer comprising:

providing a particle loaded deposition bath comprising a plurality of particles of an electron emitting material, a plurality of particles of an insulating material, a hydrophilic alcohol, water, a charging salt, and a dispersant;

positioning a conducting layer in the loaded deposition bath spaced from a counter electrode; and applying a voltage between the conducting layer and the counter electrode whereby the particles of emitting material and particles of insulating material are deposited on the conducting layer to produce the field emitting layer.

11. The method of claim 10 wherein a characteristic size of the particles of insulating material is between about one quarter and about one half of a characteristic size of the particles of emitting material.

12. The method of claim 10 wherein the emitting material is selected from the group consisting of graphite carbon, diamond, amorphous carbon, molybdenum, tin, and silicon.

13. The method of claim 10 wherein the insulating material is selected from the group consisting of alumina, silicon carbide, titanium oxide, and zirconium oxide.

14. The method of claim 10 wherein the emitting material is graphite carbon, the insulating material is γ-alumina, and the fraction of graphite carbon particles is between about 5% and 50% by weight of the total weight of graphite carbon particles and γ-alumina particles.

15. The method of claim 14 wherein the fraction of graphite carbon particles is between about 10% and 25% by weight of the total weight of graphite carbon particles and γ-alumina particles.

16. The method of claim 15 wherein a characteristic dimension of the graphite carbon particles is in the range of about 0.1 μm to about 1.0 μm.

17. The method of claim 10 wherein the fraction of water in the deposition bath is from about 1% to about 30% by volume.

18. The method of claim 10 wherein the charging salt is selected from the group consisting of $Mg(NO_3)_2$, $La(NO_3)_2$, and $Y(NO_3)_2$.

19. The method of claim 18 wherein the charging salt is present in the deposition bath at a concentration of from about $10^{-5}$ to about $10^{-1}$ moles per liter.

20. The method of claim 10 wherein the fraction of dispersant in the deposition bath is between about 1% and 20% by volume.

21. The method of claim 20 wherein the dispersant is glycerin.

22. The method of claim 10 wherein the total weight of particles per liter of deposition bath is between about 0.01 and 10 grams per liter.

23. A method of making a cathode comprising:

providing a particle loaded deposition bath comprising a plurality of particles of an electron emitting material, a plurality of particles of an insulating material, a hydrophilic alcohol, water, a charging salt, and a dispersant;

positioning a cathode support in the loaded deposition bath spaced from a counter electrode, the cathode support comprising a conducting layer on an insulating layer; and applying a voltage between the conducting layer and the counter electrode whereby the particles of emitting material and particles of insulating material are deposited on the conducting layer to produce the cathode.

24. The method of claim 23 wherein a characteristic size of the particles of insulating material is between about one quarter and about one half of a characteristic size of the particles of emitting material.

25. The method of claim 23 wherein the emitting material is selected from the group consisting of graphite carbon, diamond, amorphous carbon, molybdenum, tin, and silicon.

26. The method of claim 23 wherein the insulating material is selected from the group consisting of alumina, silicon carbide, titanium oxide, and zirconium oxide.

27. The method of claim 23 wherein the emitting material is graphite carbon, the insulating material is γ-alumina, and the fraction of graphite carbon particles is between about 5% and 50% by weight of the total weight of graphite carbon particles and γ-alumina particles.

28. The method of claim 27 wherein the fraction of graphite carbon particles is between about 10% and 25% by weight of the total weight of graphite carbon particles and γ-alumina particles.

29. The method of claim 28 wherein a characteristic dimension of the graphite carbon particles is in the range of about 0.1 $\mu$m to about 1.0 $\mu$m.

30. The method of claim 23 wherein the fraction of water in the deposition bath is from about 1% to about 30% by volume.

31. The method of claim 23 wherein the charging salt is selected from the group consisting Of $Mg(NO_3)_2$, $La(NO_3)_2$, and $Y(NO_3)_2$.

32. The method of claim 30 wherein the charging salt is present in the deposition bath at a concentration of from about $10^{-5}$ to about $10^{-1}$ moles per liter.

33. The method of claim 23 wherein the fraction of dispersant in the deposition bath is between about 1% and 20% by volume.

34. The method of claim 33 wherein the dispersant is glycerin.

35. The method of claim 23 wherein the total weight of particles per liter of deposition bath is between about 0.01 and 10 grams per liter.

* * * * *